US009845640B2

(12) United States Patent
Chen

(10) Patent No.: US 9,845,640 B2
(45) Date of Patent: Dec. 19, 2017

(54) EXTENSION LADDER WITH CUSHIONS

(71) Applicant: Dongguan Dinghan Aluminum Products Ltd., Dongguan, Guangdong (CN)

(72) Inventor: Han-Tsung Chen, Dongguan (CN)

(73) Assignee: Dongguan Dinghan Aluminum Products Ltd., Dongguan (CN)

( * ) Notice: Subject to any disclaimer, the term of this patent is extended or adjusted under 35 U.S.C. 154(b) by 0 days.

(21) Appl. No.: 15/593,452

(22) Filed: May 12, 2017

(65) Prior Publication Data

US 2017/0335625 A1 Nov. 23, 2017

(51) Int. Cl.
*E06C 1/12* (2006.01)
*E06C 7/02* (2006.01)

(52) U.S. Cl.
CPC ..... *E06C 7/02* (2013.01); *E06C 1/12* (2013.01); *E06C 1/125* (2013.01)

(58) Field of Classification Search
CPC ..... E06C 1/125
See application file for complete search history.

(56) References Cited

U.S. PATENT DOCUMENTS

2007/0267252 A1* 11/2007 Yao ..... E06C 1/125 182/195
2010/0267197 A1* 10/2010 Shieh ..... H01L 29/7869 438/104
2016/0153232 A1* 6/2016 Kieffer ..... E06C 1/125 182/104

FOREIGN PATENT DOCUMENTS

EP 2157276 A2 * 2/2010 ..... E06C 1/125
WO WO 2017034399 A1 * 3/2017 ..... E06C 1/125

* cited by examiner

*Primary Examiner* — Alvin Chin-Shue
(74) *Attorney, Agent, or Firm* — Alan D. Kamrath; Kamrath IP Lawfirm, P.A.

(57) ABSTRACT

An extension ladder includes sub-ladders and cushions. Each sub-ladder includes a rung s connected to two tubes. The tubes of each sub-ladder are telescopically connected to the tubes of an adjacent sub-ladder. Each cushion includes an air bag and a slow-release unit. The air bag includes an open end with a channel. The air bag of each cushion is inserted in a corresponding tube. The slow-release unit is operable to slowly release air from the air bag and includes a restraint and a membrane. The restraint is connected to the open end of the air bag. The membrane includes an aperture and is movable arranged between the restraint and the open end of the air bag, with the aperture in communication with the channel.

1 Claim, 4 Drawing Sheets

EXTENSION LADDER WITH CUSHIONS

BACKGROUND OF INVENTION

1. Field of Invention

The present invention relates to an extension ladder and, more particularly, to an extension ladder with cushions.

2. Related Prior Art

An extension ladder includes several rungs connected to two telescopic rails that are movable between an extended position and a shrunk position. The extension ladder allows a user to reach a high place when the telescopic rails are in the extended position. The extension ladder can easily be carried or stored when the telescopic rails are in a shrunk position. A conventional extension ladder further includes a button operable to allow the telescopic rails to move to the shrunk position from the extended position by the gravity. However, the movement of the telescopic rails to the shrunk position from the extended position is often smooth and fast. Hence, the user could easily get hurt by one of the rungs. Moreover, the telescopic rails could easily be damaged.

The present invention is therefore intended to obviate or at least alleviate the problems encountered in prior art.

SUMMARY OF INVENTION

It is the primary objective of the present invention to provide a safe and durable extension ladder.

To achieve the foregoing objective, the extension ladder includes sub-ladders and cushions. Each sub-ladder includes a rung s connected to two tubes. The tubes of each sub-ladder are telescopically connected to the tubes of an adjacent sub-ladder. Each cushion includes an air bag and a slow-release unit. The air bag includes an open end with a channel. The air bag of each cushion is inserted in a corresponding tube. The slow-release unit is operable to slowly release air from the air bag and includes a restraint and a membrane. The restraint is connected to the open end of the air bag. The membrane includes an aperture and is movably arranged between the restraint and the open end of the air bag, with the aperture in communication with the channel.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
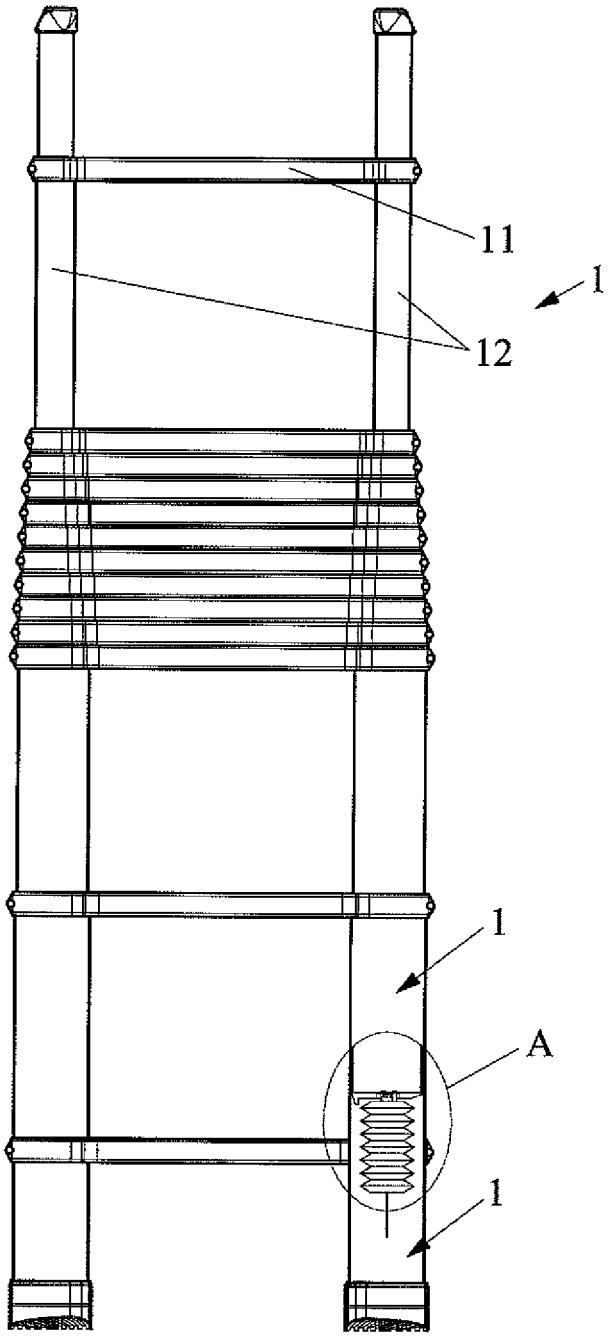
FIG. 1 is a front and cut-away view of an extension ladder according to the preferred embodiment of the present invention.

Referring to FIGS. 1 through 4, an extension ladder includes several sub-ladders 1 and several cushions 2 according to the preferred embodiment of the present invention. The sub-ladders 1 are moved from one another as the extension ladder is moved to an extended position. The sub-ladders 1 are moved toward one another as the extension ladder is moved to a shrunk position. Each of the cushions 2 is arranged between two adjacent ones of the sub-ladders 1 so that the cushions 2 are operable to reduce the speed of the movement of the sub-ladders 1 toward one another. Thus, a user is allowed to remove his or her hands from the extension ladder in time, i.e., it is safe for the user to use the extension ladder. Moreover, the sub-ladders 1 would not severely wear against one another, i.e., the extension ladder, which includes the sub-ladders 1, is durable and lasts for a long period of time.

Preferably, each of the sub-ladders 1 includes a rung 11 connected to two tubes 12. That is, the extension ladder includes two telescopic rails. Each of the telescopic rails includes a group of tubes 12 on a side of the rungs 11. In each of the groups, the tubes 12 are telescopically connected to one another. Each of the cushions 2 is used between two adjacent ones of the tubes 12.

Preferably, each of the cushions 2 includes an air bag 21 arranged between the two corresponding tubes 12. Each of the air bags 21 is made with a channel 22 at an end. Air is released from each of the air bags 21 through the channel 22 as the air bag 21 is compressed while the corresponding tubes 12 are moved toward each other, i.e., the extension ladder is moved to the shrunk position. The release of the air from each of the air bags 21 via the channel 22 is slow, and so is the compression of the air bags 21, and so is the movement of the corresponding tubes 12 toward one another. Air is sucked into the air bags 21 through the apertures 22 as the air bags 21 are expanded while the tubes 12 are moved away from one another, i.e., the extension ladder is moved to the extended position.

To control the release of the air from each of the air bags 21, each of the cushions 2 includes a slow-release unit 3 connected to the open end of the air bag 21 thereof. The slow-release units 3 are operable to slowly release air from the air bags 21 through the apertures 22, thereby rendering the movement of the sub-ladders 1 toward one another slow. The air bags 21 tend to be compressed faster as they are located lower, for carrying more weight. The slow-release units 3 are operable to cause air to be released from the air bags 21 at a same rate, thereby causing the sub-ladders 1 to be moved towards one another at a same speed.

Preferably, each of the slow-release units 3 is a check valve that includes a housing (not numbered) and a membrane 31. The housing of each of the slow-release units 3 is connected to the open end of the corresponding air bag 21, over the channel 22. The membrane 31 of each of the slow-release units 3 includes an aperture 311 in communication with the channel 22 of the corresponding air bag 21. Air is slowly released from each of the air bags 21 only via the aperture 311 of the membrane 31 of the corresponding slow-release unit 3 while the air bag 21 is compressed. Air is quickly sucked into each of the air bags 21 while the corresponding air bag 21 is expanded.

The membrane 31 of each of the slow-release units 3 is an elastic one. Each of the slow-release units 3 further includes a restraint 32 connected to the housing thereof. The membrane 31 of each of the slow-release units 31 is located between the restraint 32 of the same and the channel 22 of the corresponding air bag 21. The membrane 31 of each of the slow-release units 31 is pressed against the restraint 32 of the same to cause air to be slowly released from the corresponding air bag 21 via the aperture 311 only while the corresponding air bag 21 is compressed. The membrane 31 of each of the slow-release units 3 is removed from the restraint 32 of the same to allow air to be quickly sucked into the corresponding air bag 21 while the corresponding air bag 21 is expanded.

Figure 2:
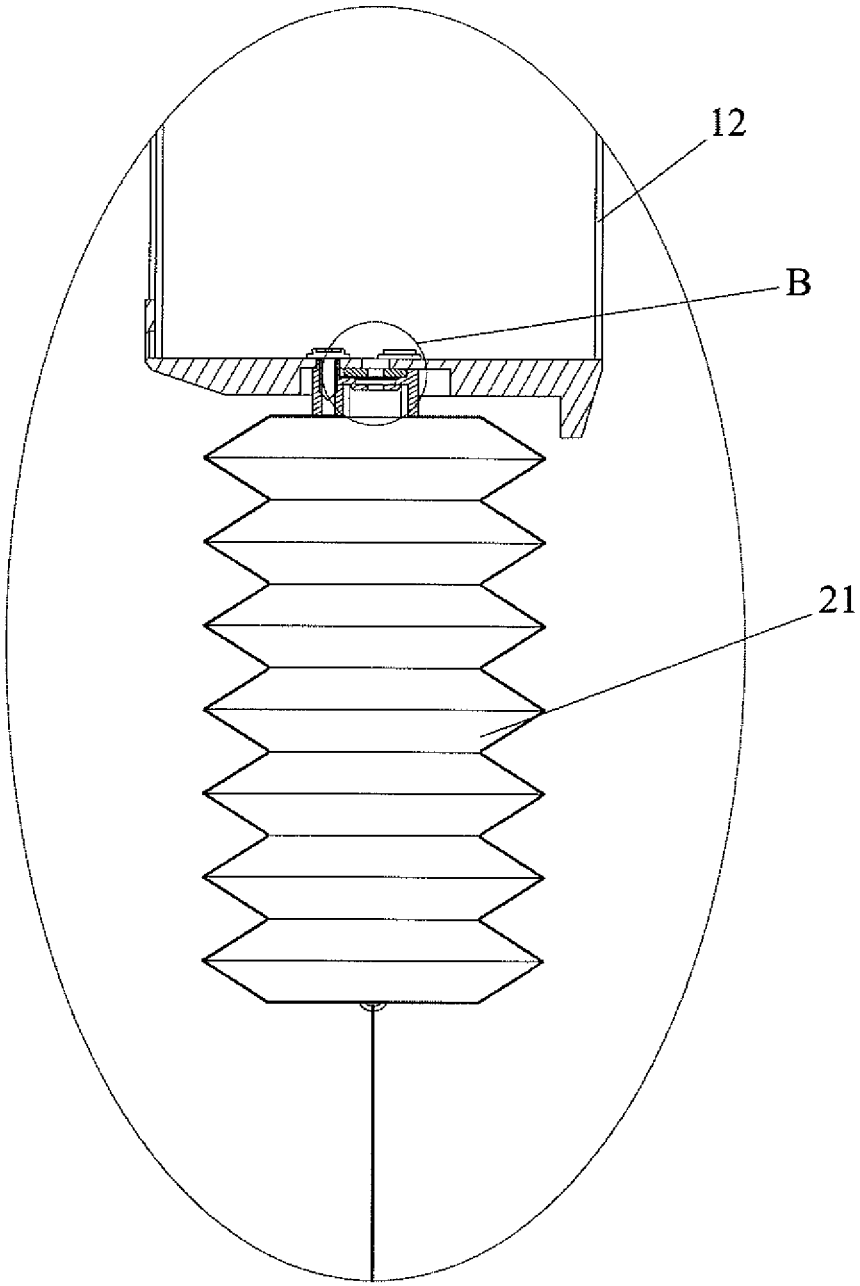
FIG. 2 is an enlarged view of a portion of the extension ladder marked by "A" shown in FIG. 1.
Figure 3:
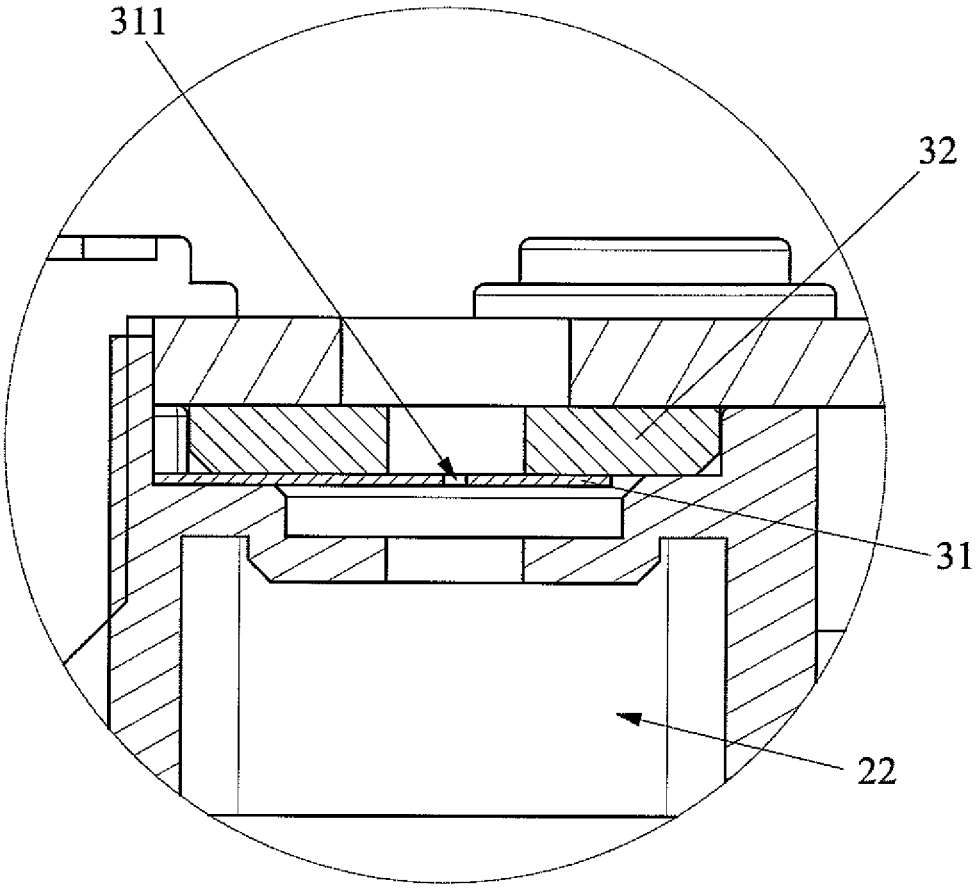
FIG. 3 is an enlarged view of a portion of the extension ladder marked by "B" shown in FIG. 2.
Figure 4:
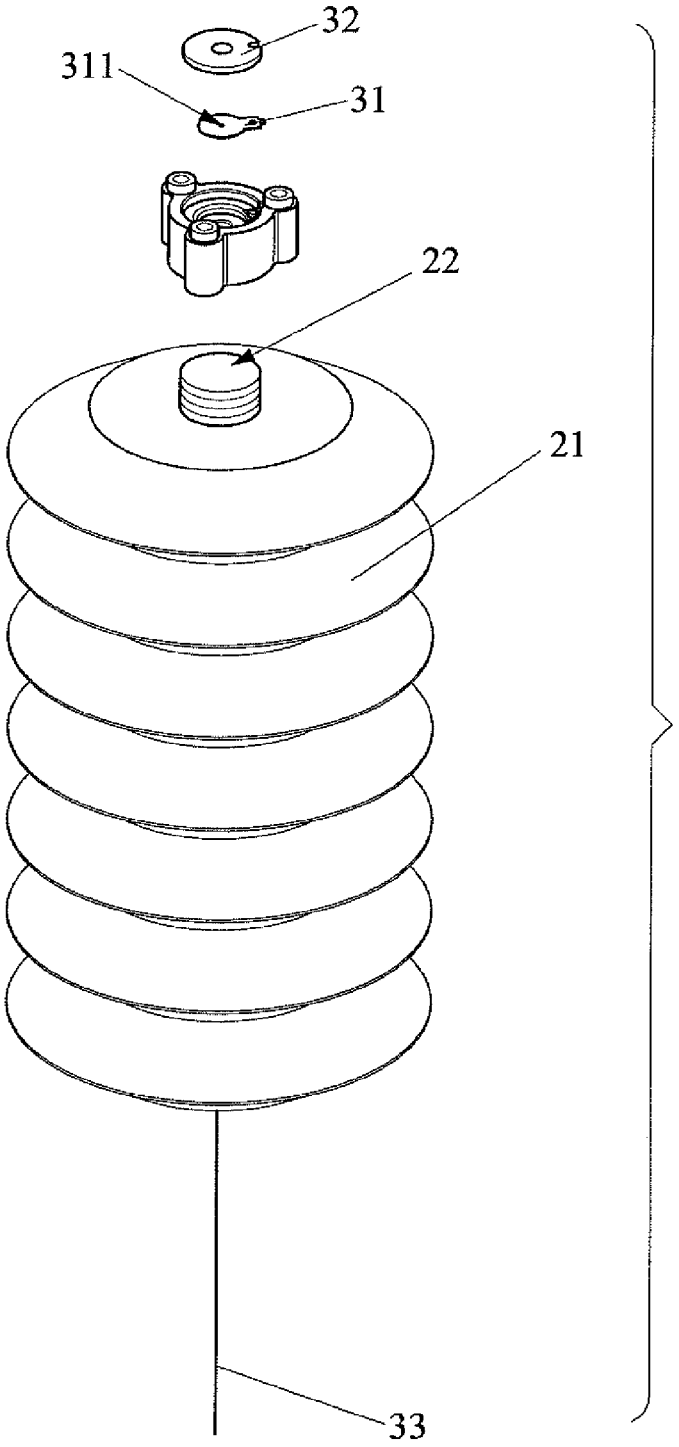
FIG. 4 is a perspective view of a cushion of the extension ladder shown in FIG. 1.

Referring to FIGS. 2 and 4, to facilitate the sucking of air into the air bags 21 to allow the expansion of the air bags 21, an end of a rope 33 is tied to a closed end of each of the air bags 21. Another end of each of the ropes 33 is tied to a corresponding one of the tubes 12 of a lower one of the sub-ladders 1. Hence, the air bags 21 are smoothly expanded by the sub-ladders 1 via the ropes 33 while the sub-ladders 1 are moved from one another.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. An extension ladder comprising:

sub-ladders (1) each of which comprises:

a rung (11) connected to the tubes (12); and two tubes (12) connected to the rung (11) and telescopically connected to the tubes (12) of an adjacent one of the sub-ladders (1);

cushions (2) each of which comprises:

an air bag (21) comprising an open end made with a channel (22), wherein the air bag (21) is inserted in a corresponding one of the tubes (12);

a slow-release unit (3) being operable to slowly release air from the air bag (21) and comprising:

a restraint (32) connected to the open end of the air bag (21); and a membrane (31) comprising an aperture (311) and being movable between the restraint (32) and the open end of the air bag (21), with the aperture (311) in communication with the channel (22), wherein each of the cushions (2) further comprises a rope (33) comprising an end tied to a closed end of the air bag (21) thereof and another end tied to a tube (12) of an adjacent one of the sub-ladders (1).

* * * * *